US006139722A

United States Patent [19]

Kirkbride et al.

[11] Patent Number: 6,139,722

[45] Date of Patent: Oct. 31, 2000

[54] PROCESS AND APPARATUS FOR CONVERTING OIL SHALE OR TAR SANDS TO OIL

[75] Inventors: Chalmer G. Kirkbride, Bradenton, Fla.; James A. Doyle, Cordobia, Tenn.; Fred Hildebrandt, Alberta, Canada

[73] Assignee: Chattanooga Corporation, Bradenton, Fla.

[21] Appl. No.: 09/058,184

[22] Filed: Apr. 10, 1998

Related U.S. Application Data

[60] Continuation-in-part of application No. 08/843,178, Apr. 14, 1997, Pat. No. 5,902,554, which is a division of application No. 08/551,019, Oct. 31, 1995, Pat. No. 5,681,452.

[51] Int. Cl.[7] ..... C10G 1/00; C10G 1/06; C10B 57/00; C10B 51/00; C07C 1/00

[52] U.S. Cl. ..... 208/418; 208/409; 201/2.5; 201/25; 585/241; 585/242

[58] Field of Search ..... 208/409, 418; 201/2.5, 25; 585/241, 242

[56] References Cited

U.S. PATENT DOCUMENTS

| | | | |
|---|---|---|---|
| 3,001,652 | 9/1961 | Schroeder et al. | 214/17 |
| 3,030,297 | 4/1962 | Schroeder | 208/8 |
| 3,093,420 | 6/1963 | Levene et al. | 302/53 |
| 3,762,773 | 10/1973 | Schroeder | 302/53 |
| 4,206,032 | 6/1980 | Friedman et al. | 308/8 R |

*Primary Examiner*—Walter D. Griffin
*Assistant Examiner*—Tam M. Nguyen
*Attorney, Agent, or Firm*—Morgan & Finnegan, LLP

[57] ABSTRACT

The invention relates to a continuous process for producing synthetic crude oil from oil bearing material, e.g., oil shale or tar sand, through continuous feeding and calcining, hydrocracking and hydrogenating kerogen or bitumen.

41 Claims, 6 Drawing Sheets

PROCESS AND APPARATUS FOR CONVERTING OIL SHALE OR TAR SANDS TO OIL

RELATED APPLICATIONS

This application is a continuation-in-part of application Ser. No. 08/843,178, now U.S. Pat. No. 5,902,554 filed on Apr. 14, 1997, which in turn is a division of application Ser. No. 08/551,019, filed Oct. 31, 1995, now U.S. Pat. No. 5,681,452, each of which is hereby incorporated herein by reference.

FIELD OF THE INVENTION

The present invention relates to a continuous process for producing synthetic crude oil (SCO) from oil shale or tar sand and an apparatus for its practice. More specifically, the present invention provides a process for treating dry tar sand or shale without prior beneficiation, in a reactor operating at elevated pressure and temperature conditions, in the presence of substantially only hydrogen gas. The spent shale or tar sand can then be used to prepare soil and construction compositions.

BACKGROUND OF THE INVENTION

There are some tar sand systems that are successful in making SCO, such as those in the Canadian Athabasca tar sand area that surface mine and process the tar sands, where they first separate sand (85%) from bitumen (15%) to avoid processing the sand in the reaction systems. The separated bitumen is converted to sweet, light crude oil by conventional refinery type operation. Separation of the sand from the bitumen requires beneficiating operations such as floatation cells and secondary separation equipment and processing and equipment to prepare the tar sand for flotation. Tailing oil recovery is necessary to clear the sand for disposal, however the sand is not completely cleared of bitumen.

Existing technology uses a large number of physical and chemical processing units for the treatment of wet tar sands, e.g., fluid cokers, LC finer, tumblers (being phased out by hydro-pumping), beneficiation including: primary separation vessels with floatation cells and secondary separation systems necessary to recover the bitumen from the tar sand; tailing oil recovery systems which result from the sand not being completely cleared of bitumen; tailing settling ponds which are necessary to settle and separate fine clays and other undesirable solids from the water required for floatation since the water must be reused to maximize clean-up to reduce environmental problems. These systems require large facilities along with the maintenance and reclamation required.

For example, U.S. Pat. Nos. 5,340,467 and 5,316,467 to Gregoli, et al. relate to the recovery of hydrocarbons (bitumen) from tar sands. In the Gregoli, et al. patent process, tar sand is slurried with water and a chemical additive and then sent to a separation system. The bitumen recovery from tar sand processes described in U.S. Pat. Nos. 5,143,598 to Graham et al. and 4,474,616 to Smith, et al. also involve the formation of aqueous slurries. Other processes involving slurries, digestion, or extraction processes are taught in U.S. Pat. Nos. 4,098,674 to Rammler, et al., 4,036,732 to Irani, et al., 4,409,090 to Hanson, et al., 4,456,536 to Lorenz, et al. and Miller, et al.

In situ processing of tar sand is also known as seen from the teachings of U.S. Pat. Nos. 4,140,179, 4,301,865 and 4,457,365 to Kasevich, et al. and 3,680,634 to Peacock, et al.

U.S. Pat. No. 4,094,767 to Gifford relates to fluidized bed retorting of tar sands. In the process disclosed by the Gifford patent, raw tar sand is treated in a fluidized bed reactor in the presence of a reducing environment, steam, recycle gases and combustion gases. The conversion of the bitumen, according to the Gifford patent, is through vaporization and cracking, thereby leaving a coked sand product. The steam and oxygen, according to Gifford are "injected into the fluidized bed in the decoking area above the spent sand cooling zone, and below the input area in the cracking zone for fresh tar sand."

The process and apparatus of the present invention avoid the use of the large number of physical and chemical processing units used in the processing of wet tar sand by using a single continuous reactor system to hydrocrack and hydrogenate the dry tar sand. Moreover, because the present invention directly hydrogenates dry tar sand, larger quantities of valuable sweet, light crude oil is obtained. Moreover, with the present invention, less gas and substantially no coke is produced.

BRIEF SUMMARY OF THE INVENTION

The present invention relates to a continuous process for converting oil bearing material, e.g., oil shale or tar sand, and an apparatus for its practice.

Accordingly, one aspect of the present invention is to provide a continuous process and an apparatus for its practice where oil bearing material such as the kerogen in oil shale or the bitumen in tar sand is continuously treated.

Another aspect of the present invention relates to the treatment of dry tar sand.

An object of the present invention is providing a process for converting tar sand to oil through the use of substantially only hydrogen.

Another object of the present invention is providing a heat recovery process whereby hydrogen provides the heat necessary to bring the raw tar sand up to reactor temperature.

A still further object of the present invention is providing a process where hydrogen is used for hydrocracking and hydrogenating the bitumen in the tar sand or oil shale.

A further objective of the present invention is providing a process for using recycle and make-up hydrogen as a heat transfer vehicle.

A still further object of the present invention is to produce dry, relatively clean sand as waste that will not pollute and can be used as excellent landfill for permanently improved and desirable land.

Objects and advantages of the invention are set forth in part herein and in part will be apparent herefrom, or may be learned by practice with the invention, the same being realized and attained by means of the flow charts, process steps, structures, instrumentalities and combinations pointed out in the appended claims. Accordingly, the invention resides in the novel steps, parts, structures, arrangements, combinations and improvements herein shown and described.

BRIEF DESCRIPTION OF THE DRAWINGS

In FIGS. 1–6, common elements are similarly identified except for the "figure number" designation. Thus, all elements depicted in FIG. 1, start off with the number 1, e.g., the reactor in FIG. 1 is identified as "104" and in FIG. 2 the same reactor is identified as "204."

DETAILED DESCRIPTION OF THE INVENTION

Figure 1:
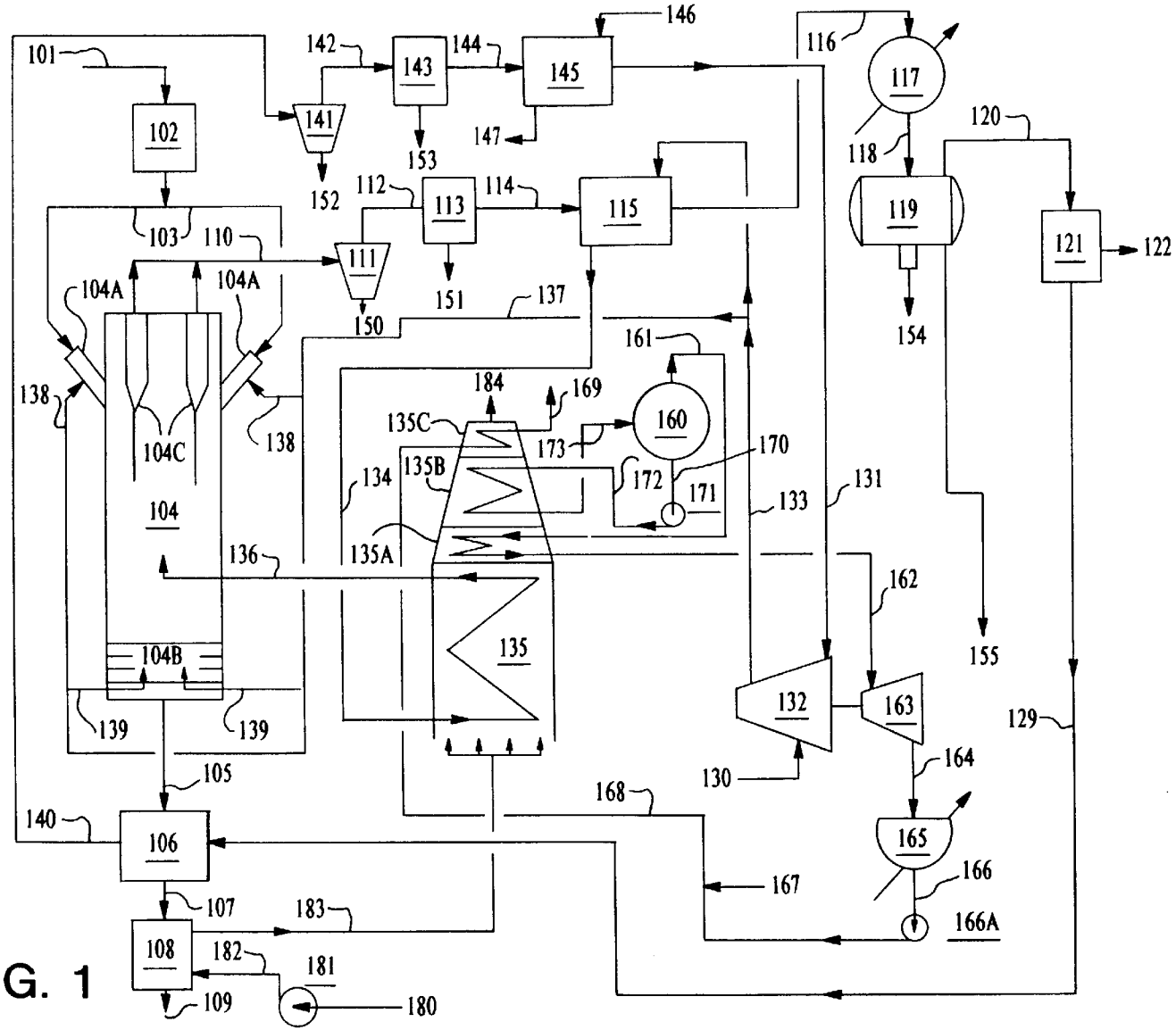
FIG. 1 shows the flow diagram of one embodiment according to the present invention.

In the present invention the hydrocarbon content of the hydrocarbon bearing solids, e.g., dry tar sand or oil shale is reacted in a fluidized bed reactor with hydrogen and the process is operated to avoid decompression of the hydrogen. In the present invention, the hydrocarbon bearing solid does not include bituminous or anthracite coals or similar type material. A first portion of a substantially only hydrogen stream is used to feed the oil shale or tar sand, which has been comminuted and reduced in size to form particles that are capable of being fluidized, e.g., fluidizable, into the reactor. A second portion of the hydrogen stream is used as the fluidizing medium. The hydrogen stream that is used in the present invention is formed from fresh make-up hydrogen and recycle hydrogen generated during the process, or obtained from other hydrogen producing processes. A mixed fresh-make-up and recycle hydrogen stream is discharged from a compressor at a first temperature and pressure, and a portion is diverted for admixture with the fluidizable particles of tar sand or oil shale which are injected into the fluidized bed reactor in a fan like flow, at an acute angle relative to the vertical axis of the reactor or a horizontal plane. The remainder of the hydrogen stream at said first temperature is indirectly heated to a second higher temperature by indirect heat exchange with overhead products from the fluidized bed reactor. The hydrogen stream at said second temperature is conveyed to a direct fired heater where the hydrogen stream is heated to a third temperature higher than said second temperature and then used as the fluidizing medium in the reactor to fluidize the tar sand or oil shale fluidizable particles that have been injected with the first portion of the hydrogen stream.

In the fluidized bed reactor the bitumen in the tar sand or the kerogen in the oil shale and hydrogen are reacted via endothermic and exothermic reactions to produce spent tar sand or oil shale and an overhead product stream that contains hydrogen, hydrogen sulfide, sulfur gases, $C_1$+$C_2$ hydrocarbons, ammonia, fines (sand particles and clay) and vaporous products. The overhead product stream is first separated in cyclone separators within the reactor which help maintain the bed level and separate solids. The first separated overhead product is conveyed to a series of additional separators to provide a particle free clean product stream. The cleaned product stream at a first temperature is conveyed to a first heat exchange unit where heat is transferred to a second portion of the hydrogen stream and results in a product stream at a second temperature lower than said first product stream temperature. The product stream at said second temperature is conveyed to a condenser to further reduce its temperature to a third temperature lower than the second product stream temperature. The product stream at said third temperature contains liquid and gas fractions and is conveyed to a separator where the gas fraction is removed, sent to an amine scrubber, and recycled as a scrubbed recycle hydrogen stream, and the liquid fraction is removed as oil product (SCO). The cooled, absorbed overhead hydrogen stream is conveyed to a heat exchanger where it contacts spent tar sand or spent shale and its temperature is elevated due to heat transferred from the spent discharge. The hydrogen stream at the elevated temperature is conveyed to a cyclone separator, or other suitable separating devices to remove particles. It then flows to the amine system to regenerate the amine solution. It is eventually conveyed to a compressor where it is combined with fresh make-up hydrogen for use in the fluidized bed reactor as the first and second portions of the hydrogen stream.

The invention will now be described with reference to the figures. FIG. 1 is a flow chart of one embodiment of the present invention where tar sand is converted to oil. In accordance with the present invention, tar sand from the run of mine conveyor belt 101 is continuously fed to any suitable sizing equipment 102 for classifying tar sand, at a temperature of about 50° F. Tar sand is composed of bitumen and sand.

The bitumen in the tar sand that is processed in the present invention normally contains heavy metals which catalytically help promote the endothermic and exothermic reactions in reactor 104. However, it may be advantageous to add additional catalyst. The tar sand processed in accordance with the present invention is exemplified by the following, non-limiting example:

| TAR SAND FEED | | |
|---|---|---|
| sand | | 84.6 wt. % |
| bitumen | | 15.4 wt. % |
| carbon | 83.1 wt. % | |
| hydrogen | 10.6 wt. % | |
| sulfur | 4.8 wt. % | |
| nitrogen | 0.4 wt. % | |
| oxygen | 1.1 wt. % | |
| nickel | 75 PPM | |
| vanadium | 200 PPM | |
| | 100 wt. % | 100 wt. % |

Figure 2:
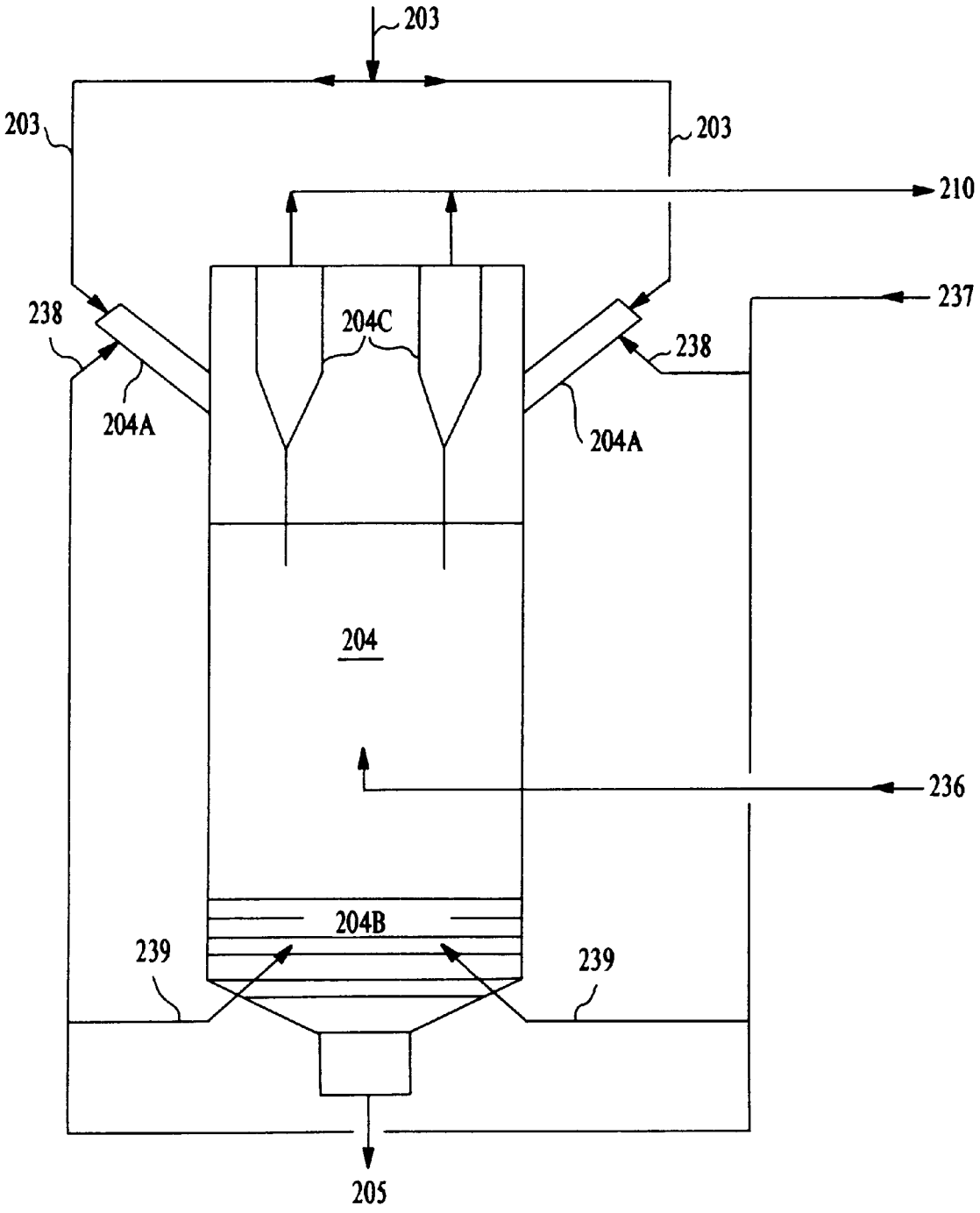
FIG. 2 shows a fluidized bed reactor for converting bitumen in tar sand to viable products in accordance with the present invention.

In the present invention dry tar sand having an average particle size of that of sand is conveyed through conduit 103 as the feed for fluidized bed reactor 104, discussed in greater detail in FIG. 2. Tar sand particles which are oversized are either recycled to the sizing equipment 102, or conveyed to any suitable equipment for reducing the size of the oversized feed. In the present invention, the phrase "dry tar sand" means, under atmospheric conditions, a friable, non-sticky, easily handled, substantially free flowing material.

Tar sand is fed through pressure feeder rotary valves 104A which are circumferentially positioned adjacent and around the upper end of the fluidized bed reactor 104, which is described in detail greater in FIG. 2. The rotary feeders 104A are positioned at an angle of between 20 and 60 degrees relative to the vertical reactor axis in order to "fan feed" the fluidizable sized tar sand into the top of the reactor 104. More uniform dispersion of the tar sand in the fluidized bed reactor can be obtained when three or more rotary feed valves 104A are positioned equidistantly around the circumference of the reactor. Although three feeders 104A are preferred, the size of the reactor and the degree of fanning desired will control the number of valve feeders. Thus, there could be 4, 5, 6, 7 or more valve feeders used in the present invention.

High pressure hydrogen is conveyed through lines 138 to the feeders 104A, at a pressure of between 625 psi and 700 psi, preferably about 635 psi, to assist in injecting, feeding and dispersing the tar sand into reactor 104.

The process performed in fluidized bed reaction 104 involves hydrocracking, which is an endothermic reaction, and hydrogenation, which is an exothermic reaction, which reactions are conducted to favor the production of liquid fuels and minimize the production of gas yields. The reactor operates at temperatures of between 800° F. and 900° F., preferably closer to 800° F. to avoid cracking the large fragments of hydrogenated bitumen in the tar sand.

It is advantageous to conduct the endothermic hydrocracking and exothermic hydrogenating processing of tar sand in reactor 104 in a predominantly hydrogen gas environment. The hydrogen atmosphere in reactor 104 is maintained at about 600 psi by fresh make-up hydrogen conveyed through line 130 from a hydrogen plant and a hydrogen recycle stream 129 which contains cleaned-up hydrogen. The volume of recycle hydrogen to fresh make-up hydrogen is preferably at least about 26 to 1.

Advantageously all the high pressure hydrogen for the process of the present invention, for reaction in reactor 104 and the various heat exchange operations, is provided by the steam powered compressor 132. Compressor 132 receives fresh make-up hydrogen which is conveyed through line 130 and recycle hydrogen which is conveyed through lines 129, 140, 142, 144 and 131. Compressor 132 is powered by steam conveyed through line 162 from direct fired heater 135.

Reactor 104 operates in a highly agitated fashion insuring almost instant and complete reaction between the bitumen components and hydrogen. The residence or retention time of the tar sand in reactor 104 is about 15 minutes, but could be between 10 and 20 minutes, depending on the throughput and efficiency of the reactor process. The pressure drop from the bottom to the top of the reactor 104 is about 35 psi.

Overhead products from reactor 104 are discharged from reactor 104 through cyclone separators 104C, while solids are discharged through separator section 104B located at the lower end of reactor 104. The cyclones separators 104C discharge an overhead stream, e.g., gas and vapor reaction components, off-gas and product, through their upper ends into line 110, while separated solids are discharged through the lower ends of the dip legs. The cyclone separators 104C extend about 20 feet down into the reactor 104 and establish the bed height in the reactor 104.

The hot spent tar sand is continuously discharged at a pressure of about 635 psi and a temperature of about 800° F. through lock hopper valving arrangement 104B in the lower end of reactor 104 into line 105 which conveys the discharged material to spent sand heat exchangers 106 and 108.

The reactor overhead stream from the cyclone separators 104C is discharged into line 110, at a temperature of about 800° F. and a pressure of about 600 psi. The overhead stream discharged from the reactor 104 still contains dust and dry waste particles, and is first conveyed through line 110 to cyclone separator 111 where solids are separated and removed through line 150. The gaseous effluent from separator 111 is conveyed through line 112 to an electrostatic precipitator 113 for the final cleanup. The cleaned overhead stream from precipitator 113 is removed and conveyed through line 114, and separated solids are discharged through line 151. Cyclone separator 111 and electrostatic precipitator 113 are of conventional design and one of ordinary skill in the art practicing the present invention can select suitable devices for performing the described operation.

The cleaned stream from the precipitator 113, product, vaporous components, and off gas, are conveyed to in-and-out heat exchanger 115 through line 114. In the in-and-out exchanger 115 the cleaned stream from line 114 is brought into indirect heat exchange relationship with hydrogen being conveyed through line 133, from compressor 132, i.e., recycle and fresh make-up hydrogen, whereby heat is transferred from the cleaned stream to the hydrogen in line 133 prior to the hydrogen stream entering the fired heater 104. The cooled and cleaned stream, products, vaporous components, off-gases, from heat exchanger 115 is discharged into line 116 while hydrogen is discharged into line 134 which conveys the hydrogen to the direct fired heater 134.

The cooled stream being conveyed through line 116 is introduced into condenser 117 and is discharged at a temperature of about 100° F. into line 118. The vapor and gas stream from the condenser is conveyed through line 118 at a temperature of 100° F. and is introduced into separator 119 where vapors and liquid are separated and discharged.

Since the gas stream has been cooled down to about 100° F. and is still at a pressure of 480 psi, all carbon compounds $C_3$ and above have been condensed are removed from the separator 119 through flow line 155 to storage. Sour water from the separator is discharged through flow line 154. The crude oil product stream in line 155 is a mixture of naphtha and gas oils having an A.P.I. of approximately 33.5 and is a light sweet crude. The gas stream in line 120 is conveyed to a scrubbing system, e.g., at least one amine absorption column 121 where sulfur components, e.g., hydrogen sulfide and sulfur dioxide gases, are absorbed and discharged through line 122 and conveyed to a suitable sulfur recovery plant. The amine absorption system 121 is described in greater detail in FIG. 5.

The only gases not absorbed and removed in absorption system 121 are unreacted recycle hydrogen and $C_1$+$C_2$ hydrocarbons which are conveyed through line 129 to heat exchangers 106 so that the spent tar sand is cooled and the recycle hydrogen and $C_1$+$C_2$ hydrocarbons is heated and discharged into line 140. The $C_1$ and $C_2$ hydrocarbons in line 129 will not be absorbed nor condensed but will be recycled with the unreacted hydrogen after processing in units 141, 143 and 145 discussed hereinafter. The $C_1$ and $C_2$ hydrocarbons will reach equilibrium within the reactor 104 at about 2% and will then add to the production of crude oil per ton of tar sand. A small offset will be the increase in the recycle stream.

As discussed above, the spent sand from the reactor 104 is discharged into a succession of heat exchangers 106 and 108. The first heat exchanger 106 cools the sand from 792° F. to 400° F. using cool recycle hydrogen being conveyed through line 129. The cooled spent sand is conveyed in line 107 from heat exchanger 106 and introduced into a second heat exchanger 108 so that the sand is cooled by cold air introduced through line 180 from blower 181 and through line 182, before discharging. The air heated by the spent sand is discharged into line 183 which conveys the heated air to fired heater 135 for combustion therein. Although two heat exchangers are shown, the invention contemplates using more if necessary.

The heated and partial recycle hydrogen stream conveyed through line 140 is introduced into cyclone 141, discharged into line 142 which conveys the stream to precipitator 143, and then through line 144 for introduction into exchanger 145.

Fluidized Bed Reactor

FIG. 2 schematically shows the pressurized, continuously operating fluid bed reactor 204 in accordance with the present invention. Sized and screened tar sand or shale are conveyed through lines 203 and fed through pressure feeder rotary valves 204A into the top of the reactor 204. A portion of the gases processed in compressor 132 (FIG. 1), and heated in fired heater 135 (FIG. 1) are conveyed by line 236 and introduced into fluidized bed reactor 204 in an upward direction to fluidize the bed of the reactor 204. Another portion of the hydrogen gas from line 133 is conveyed through line 237 to tar sand feed valves 204A through lines 238. Another portion of the hydrogen gas feed from line 237 is diverted through lines 239 and injected into the separator section 204B, at the bottom end of reactor 204. Hydrogen conveyed in lines 239 is injected into the separator section 204B of reactor 204 through injectors which are located at the ends of flow lines 239 (not shown) and aid in heat retention in the reactor system and spent sand discharge through line 205.

High temperature and high pressure hydrogen (make-up and recycle) after passing through the direct fired heater 135, is introduced into reactor 204 from line 236. Reaction products and unreacted hydrogen exit the reactor through internal cyclones 204C ensuring even flow out of the reactor. Although two cyclone separators are shown, the invention contemplates using as many as necessary to provide even flow of product gases from reactor 204 and bed height maintenance. The hot reactor effluent stream in line 210 is then conveyed to physical and chemical units, described in FIG. 1 for cleanup heat recovery and product separation.

Direct Fired Heater

Figure 3:
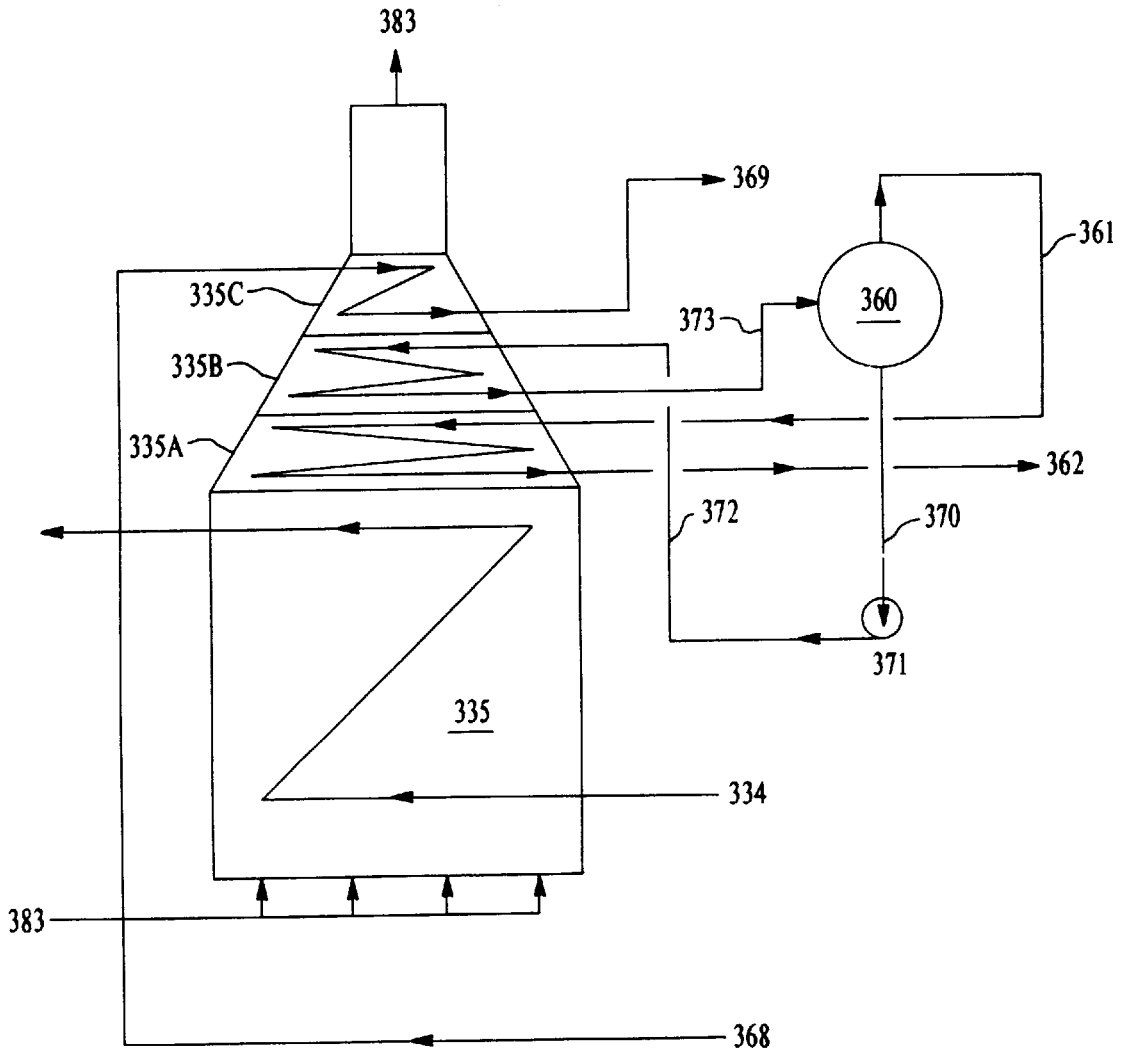
FIG. 3 shows a stand-alone fired heater used in the process according to the present invention.

As discussed above with reference to FIG. 1, a portion of the fresh make-up and cleaned recycle hydrogen from the compressor is conveyed to a direct fired heater. FIG. 3 schematically shows a fired heater 335 (135) that is designed to balance out the total energy required to operate the reactor system. Preheated air conveyed through feed lines 383 (183) is combusted with fuel in the radiant section of fired heater 335 (135) and elevates the temperature of the recycle and make-up hydrogen that is conveyed through line 334 (134). The fuel that is combusted is obtained from the $C_3$ fraction, e.g. propane, or natural gas produced or purchased from the described process or other sources. The hydrogen stream in lines 334 (134) has been preheated in the reactor in-out exchanger 115 to approximately 750° F. Since the hydrogen stream is circulated through the radiant section of the heater 335 the temperature of the hydrogen stream is elevated to a temperature of about 1200° F. Circulation of the hydrogen stream through line 133, 134, exchanger 115 and fired heater 335 is maintained by compressor 132 so that the 1200° F. hydrogen stream can be introduced into reactor 104 (FIG. 1) or 204 (FIG. 2).

Waste heat from the radiant section of direct fired heater 335 is recovered in convection section 335A (135A), 335B (135B) and 335C (135C). Steam separated in drum 360 (160) is discharged into line 361 (161) and introduced into convection section 335A (135A) where the steam temperature is raised from about 596° F. to about 800° F. After passing through convection section 335A (135A), the super heated, high pressure steam is conveyed through line 362 (162) to drive the steam turbine 163. Reduced temperature and pressure steam from turbine 163 is conveyed to steam condenser 165 and the condensate recirculated via line 166 and pump 166A. The flow from pump 166A is conveyed through line 168 (368) and combined with make-up water from line 167. The water being conveyed in line 268 is introduced into convection section 335C (135C), heated and discharged through line 369 (169) for further processing, e.g., deaeration.

Steam drum 360 (160) separates steam which is conveyed to radiant section 335A (135A) through line 161 to produce superheated steam for the turbine compressor 163.

The steam circulation loop include steam drum 360 (160), line 370 (170), recirculation pump 371 (171) and lines 372–373 (172–173) which conveys boiler water through radiant section 335B (135B) and back into drum 360 (160). Water for the boiler system is provided through feed line 467 (167) which flows into line 468. Line 468 is similar to flow line 168, 368 which communication with line 169 through connection section 335*a* (135*a*) to discharge.

As discussed above, convection section 335A (135A) super heats steam which is conveyed through line 362 (162) to drive compressor turbine 163, which drives compressor 132. Steam is generated in convection section 335B (135B) and make-up water and turbine condensate for boiler feed water are preheated in convection section 335C (135C).

Compressor System

Figure 4:
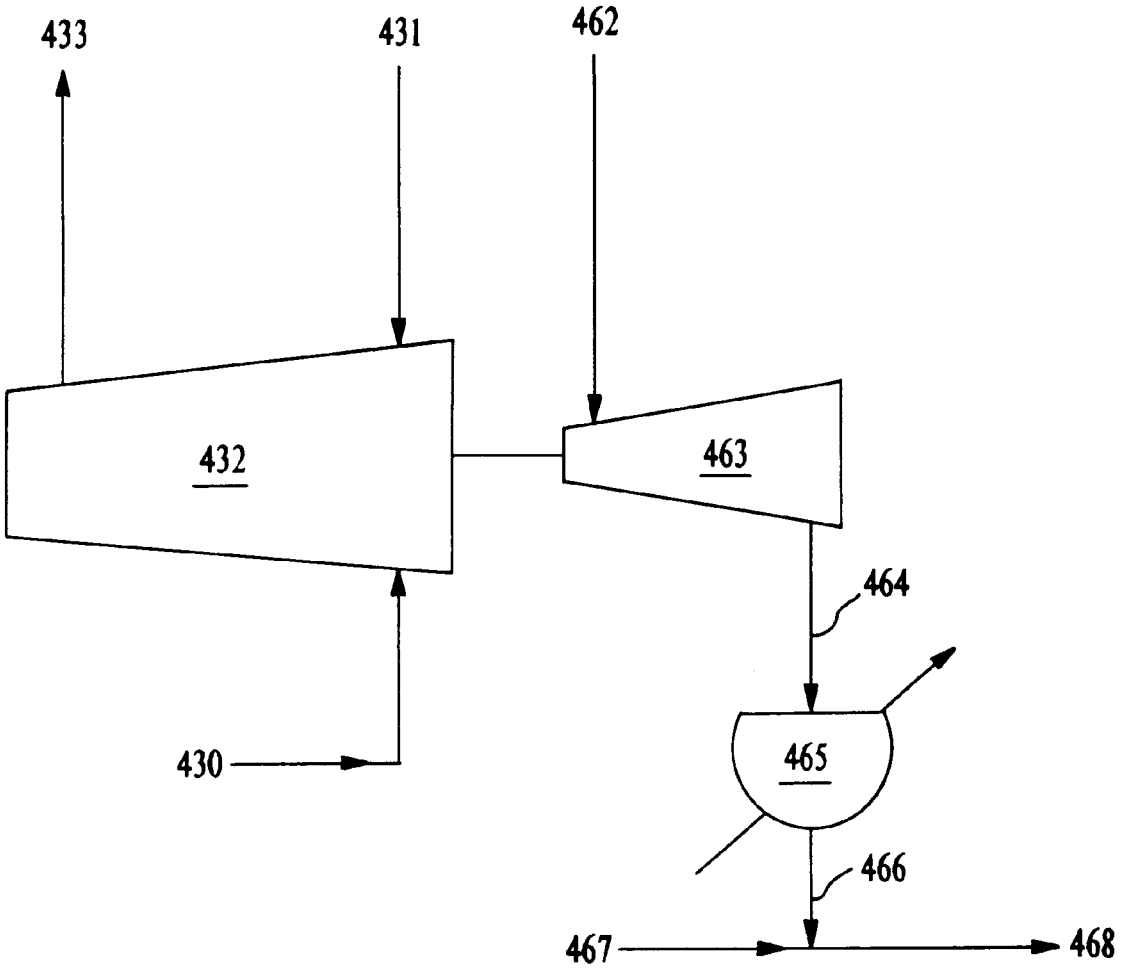
FIG. 4 shows a compressor for supplying the hydrogen for use in the present invention.

FIG. 4, schematically shows a compressor 432 (132) driven by a high pressure steam turbine 463 (163) required to maintain circulation of gases to operate the reactor system 104. Make-up hydrogen 430 (130) and recycle hydrogen 431 (131), at approximately 450 psig and 100° F. are pressurized by the compressor 432 (132) to approximately 670 psig and 122° F. and discharged into line 133 which conveys and introduces the high pressure hydrogen into the in-out exchanger 115 to be further heated by exchange with reactor product gases.

High pressure steam in line 162, 362, at 1500 psig and 800° F. drives the turbine 463 (163). Exhaust steam 464 (164) is condensed in condenser 465 (165), and along with make-up water 467 (167) is fed to the fired heater convection section 135C, 335C for preheating and reuse as boiler feed water make-up.

Product Separation

Figure 5:
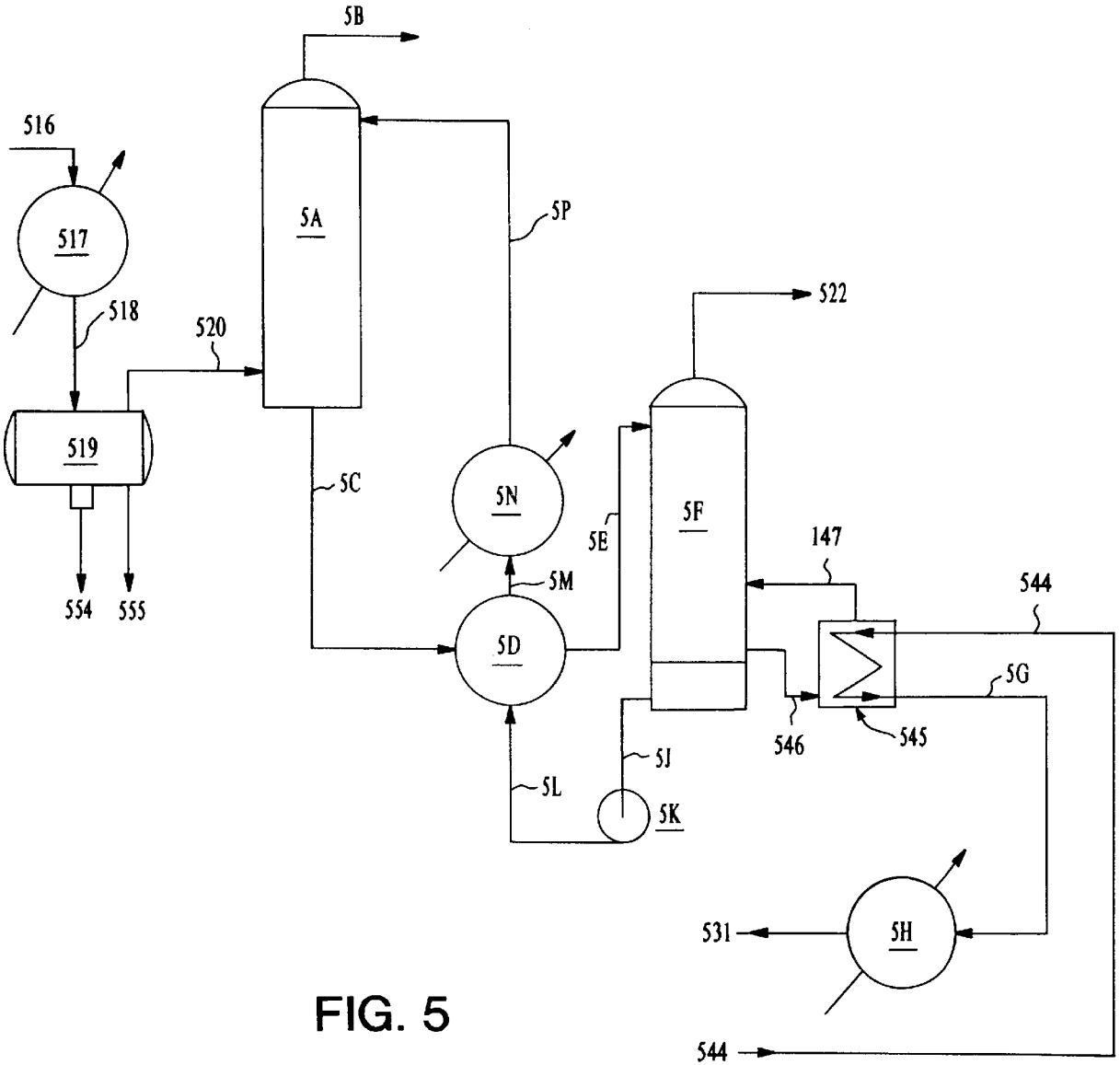
FIG. 5 shows the flow chart of an acid gas recovery system for use in the present invention.

The product separation of FIG. 1, components will be described in greater detail with reference to FIG. 5, which schematically shows the product separation from the circulating gas stream and removal of acid gasses in an amine system. Partially cooled reactor effluent gases 516 (116) from the in-out exchanger 115 are further cooled in product condenser 517 (117) and conveyed through line 518 (118) to separator 519 (119) where condensed liquids are removed as product raw crude 555 (155). Overhead gases are conveyed through line 520 (120) to an amine absorber 5A (121) where acid gasses $H_2S$, $CO_2$ and $SO_2$ are absorbed by a counter current circulating amine solution. The recycle gases 5B flow from the top of the absorber 5A to recycle hydrogen stream 129.

The rich amine solution 5C exits the bottom of the absorber, flows through an amine exchanger 5D where it is heated by exchange with hot stream amine solution 5L and enters the top of an amine stripper 5F. Absorbed acid gases are stripped from the amine solution by the application of heat to the solution in reboiler 545 (145) and are conveyed through flow line 522 (122) from the stripper to sulfur recovery off-site. Hot recycle gases are conveyed through line 544 (144) from the spent sand cooler 145 to provide heat for reboiler 545 (145) and the partially cooled recycled gases 5G are further cooled by cooler 5H and then flow through line 531 (131) to the suction side of compressor 132.

Lean amine solution 5J is circulated by amine circulation pumps 5K through the amine exchanger 5D and amine cooler 5N to the top of the amine absorber 5A to repeat the gas cleanup process.

EXAMPLE 1

Figure 6:
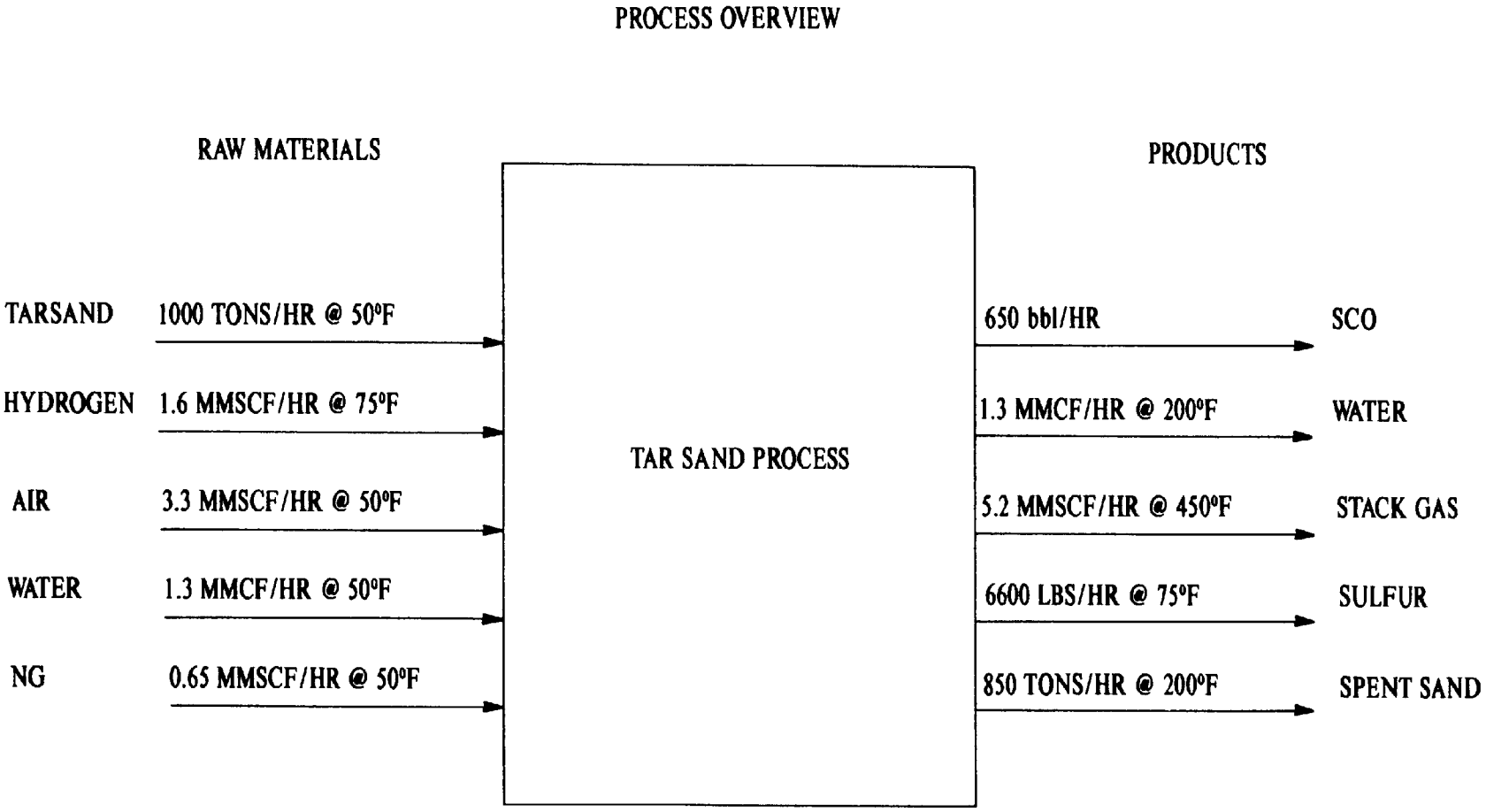
FIG. 6 shows the mass balance for one embodiment of the present invention.

The overall mass balance for the process according to the present invention is shown in FIG. 6, where 1000 tons/hr of tar sand at 50° F. are reacted with hydrogen to produce 665 bbl/hr of synthetic crude oil. The following Table provides the feed and product values for processing 1000 tons/hr. of tar sand.

| RAW MATERIALS | PRODUCTS |
|---|---|
| 1000 TONS/HR. TAR SAND | 665 BBL/HR SCO |
| 1.6 MMSCF/HR HYDROGEN | 5.2 MMSCF/HR STACK GAS |
| 3.3 MMSCF/HR AIR | 6600 LBS/HR SULFUR |
| 0.5 MMSCF/HR NATURAL GAS | 850 TONS/HR SPENT SAND |

REACTOR DIMENSIONS AND MASS AND ENERGY BALANCES

REACTOR 104

| | | |
|---|---|---|
| Column Diameter | 20.00 | ft |
| Cross Sectional Area | 314.16 | $ft^2$ |
| Void Fraction | 0.85 | (At Fluidization) |
| Cross Section of Sand | 47.12 | $ft^2$ |
| Cross Section of Gas | 267.04 | $ft^2$ |
| Reactor Volume | 27394.26 | $ft^3$ |
| Bed Diameter | 20.00 | ft |
| Bed Height | 87.20 | ft |
| Time-Space Constant | 0.25 | hr |
| Pressure Drop | 35.00 | psi |

TAR SAND FEED

| | | |
|---|---|---|
| Sand Flow Rate | 1000.00 | tons/hr |
| Density of sand | 121.68 | $lbs./ft^3$ |
| Volumetric sand flow | 16436.55 | $ft^3/hr$ |
| Sand Velocity | 5.81 | ft/minute |
| Hold-up | 15.00 | minutes |

HYDROGEN

| | | |
|---|---|---|
| Hydrogen Flow Rate | 238661.44 | lbs/hr |
| | (45226343 | SCF/hr) |
| Cp of $H_2$ | 3.50 | btu/lb-° F. (@900° F.) |
| Hydrogen Recycle Ratio | 26.52 | |
| Hydrogen Flow Rate | 45.28 | SCF/hr |
| Hydrogen Velocity | 3.02 | ft/s |

OFF GAS

| | | |
|---|---|---|
| Gas Production | 0.40 | MMSCF/hr |
| MW | 30.30 | g/mole |
| Cp of flue gas | 0.55 | btu/lb-° F. |

OFF GAS COMPOSITION

| | |
|---|---|
| CO | 0.30% |
| $CO_2$ | 0.20% |
| $H_2S$ | 31.00% |
| $NH_3$ | 2.50% |
| $C_3$ | 66.00% |

ENERGY BALANCE

OVER-ALL CONSIDERATIONS

| | | |
|---|---|---|
| Heat of Reaction | 75.00 | btu/lb. Bitumen |
| Cp Sand | 0.19 | btu/ton-° F. |
| Cp Bitumen | 0.34 | btu/lb-° F. |
| Cp Tarsand (sand + Bitumen) | 426.70 | btu/ton-° F. |
| Sand Feed Temperature | 50.00 | ° F. |

-continued

| | | |
|---|---|---|
| Sand temperature at reactor inlet | 50.00 | ° F. |
| Reaction temperature | 800.00 | ° F. |
| Sand Feed | 1,000.00 | tons/hr |

TAR SAND REACTOR

REACTOR CONDITIONS

| | | |
|---|---|---|
| Heat required in reactor | 356.03 | MMbtu/hr |
| Heat generated in Reactor | 22.50 | MMbtu/hr |
| Additional Heat Required | 335.24 | MMbtu/hr |
| Minimum $H_2$ Supplied | 9000.00 | lbs./hr |
| | (1.71 | MMSCF/hr) |
| Additional $H_2$ Supplied | 229736.15 | lbs./hr |
| | (43.53 | MMSCF/hr) |
| Total $H_2$ | 238736.15 | lbs./hr |
| | (45.24 | MMSCF/hr) |
| $C_1$–$C_2$ Flow within $H_2$ Stream | 4594.72 | lbs/hr |
| (at equilibrium −2%) | (0.08 | MMSCF/hr) |
| Entering $H_2$ Temperature | 1200.00 | ° F. |
| Cp $H_2$ | 3.50 | btu/lb-° F. |
| Heat Supplied by $C_1$–$C_2$ | 1.01 | MMbtu/hr |
| Heat Supplied by $H_2$ | 334.23 | MMbtu/hr |
| $H_2$ Recycle ratio | 26.53 | |

REACTOR BOTTOMS COOLER:

Assures Efficient Removal of Exiting Solids

| | | |
|---|---|---|
| Cold Hydrogen Cooler Stream | 1,148.68 | lbs./hr |
| | (0.22 | MMSCF/hr) |
| Heat Removed | 2.73 | MMbtu/hr |
| Entering Hydrogen Temperature | 121.64 | ° F. |
| Exiting Sand Temperature | 791.60 | ° F. |

SAND COOLER

SAND

| | | |
|---|---|---|
| Sand Flow Rate | 850.00 | tons/hr |
| Temperature of Entering Sand | 791.60 | ° F. |
| Temperature of Spent Sand | 180.00 | ° F. |
| Cp Sand | 0.19 | btu/lb-° F. |
| Heat Removed | 198.59 | MMbtu/hr |

HYDROGEN COOLANT FLOW

| | | |
|---|---|---|
| Hydrogen Flow | 238736.15 | lbs/hr |
| | (45.24 | MMSCF/hr) |
| Heat to Be Removed | 182.96 | MMbtu/hr |
| Entering Hydrogen Temperature | 100.00 | ° F. |
| Exiting Hydrogen Temperature | 318.96 | ° F. |

AIR COOLANT

| | | |
|---|---|---|
| Air Required for Combustion | 250000.00 | lbs/hr |
| | (3.27 | MMSCF/hr) |
| Cp Air | 0.25 | btu/lb-° F. |
| Entering Air Temperature | 50.00 | ° F. |
| Exiting Air Temperature | 300.00 | ° F. |
| Heat Removed | 15.63 | MMbtu/hr |

AMINE REBOILER

HYDROGEN SUPPLY

| | | |
|---|---|---|
| Entering Hydrogen Temperature | 318.96 | ° F. |
| Exiting Hydrogen Temperature | 100.00 | ° F. |

AMINE BOIL-OFF

| | | |
|---|---|---|
| Heat Available to the system | 182.96 | MMbtu/hr |

IN-OUT HEAT EXCHANGER

HYDROGEN TO BE HEATED

| | | |
|---|---|---|
| Hydrogen Flow | 238736.15 | lbs/hr |
| | (45.24 | MMSCF/hr) |
| Inlet $H_2$ Temperature | 121.64 | ° F. |
| Exiting $H_2$ Temperature | 750.00 | ° F. |

-continued

| | | |
|---|---|---|
| Total Heat Required | 525.05 | MMbtu/hr |

OFF GAS HEAT SUPPLY

| | | |
|---|---|---|
| Off Gas flow rate | 31978.89 | lbs/hr |
| | 0.40 | MMSCF/hr |
| Condensables in vapor phase | 214941.75 | lbs/hr |
| MW | 30.30 | lb/lb-mole |
| Cp Vapor | 0.55 | btu/lb-° F. |
| Cp Liquid | 0.45 | btu/lb-° F. @ 70° F. |
| Cp Non-Condensables | 3.00 | btu/lb-° F. |
| Heat of Vaporization | 65.00 | btu/lb |
| Hydrogen Recycle Flow | 229736.15 | lbs/hr |
| in Stream | (*43.53 | MMSCF/hr) |
| Inlet Temperature | 800.00 | ° F. |
| Exit Temperature | 350.00 | ° F. |

PRODUCT CONDENSER/COOLER

PRODUCT SIDE

| | | |
|---|---|---|
| Entering Temperature | 350.00 | ° F. |
| Exiting Temperature | 100.00 | ° F. |
| Condensate | 214941.75 | lbs/hr |
| | 665.29 | bbl/hr |

Heat Removal

| | | |
|---|---|---|
| $H_2$ | 201.02 | MMbtu/hr |
| Off Gas | 4.40 | MMbtu/hr |
| Condensate | 38.15 | MMbtu/hr |
| Total | 243.57 | MMbtu/hr |
| COOLER REQUIREMENT | 243.57 | MMbtu/hr |

COMPRESSOR

HYDROGEN SIDE

| | | |
|---|---|---|
| Flow Rate | 755412.69 | SCF/min |
| | 45.32 | MMSCF/hr |
| Pressure Out | 670.00 | psi |
| Pressure In | 450.00 | psi |
| DP | 220.00 | psi |
| gamma (Cp/Cv) | 1.40 | |
| # Stages | 3 | |
| Temperature Inlet | 100.00 | ° F. |
| Mechanical Efficiency | 0.80 | *100% |
| Pb/Pa | 1.14 | |
| Power Requirement per Stage | 6366.67 | hp |
| Total Power Required | 19100.00 | hp |
| Outlet Temperature | 121.64 | ° F. |

STEAM SUPPLY

| | | |
|---|---|---|
| Pressure | 1500.00 | psi |
| Temperature | 800.00 | ° F. |
| Degree Superheat | 200.00 | ° F. |
| Saturation Temperature | 596.20 | ° F. |
| Steam Heat Value | 1364.00 | btu/lb |
| Flow Rate | 10894.28 | lbs/hr |

FIRED HEATER

PRODUCTS TO BE HEATED

| | | |
|---|---|---|
| Hydrogen Flowrate | 238736.15 | lbs/hr |
| | 45.24 | MMSCF/hr |
| Hydrogen Temperature | 750.00 | ° F. |
| Water Flow Rate | 10894.28 | lbs/hr |
| Water Temperature | 75.00 | ° F. |
| Heat Duty | 517.83 | MMbtu/hr |

$C_3$'S
(FUEL PRODUCED BY THE PROCESS)

| | | |
|---|---|---|
| Flow Rate | 4263.85 | lbs/hr |
| | (0.04 | MMSCF/hr) |
| Heat of Combustion | 20000.00 | btu/lb |
| Cp | 0.60 | btu/lb-° F. |
| Temperature in | 75.00 | ° F. |
| Heat Supplied | 79.84 | MMbtu/hr |

-continued (After temperature correction)

MAKE-UP METHANE

| | | |
|---|---|---|
| Combustion Temperature | 2200.00 | ° F. |
| Heat Remaining to be supplied by Methane | 437.99 | MMbtu/hr |
| Flow Rate | 21653.89 | lbs/hr |
| | (0.51 | MMSCF/hr) |
| Heat of Combustion | 20227.00 | btu/lb |
| (After temperature correction) | | |
| Temperature in | 75.00 | ° F. |

COMBUSTION AIR

| | | |
|---|---|---|
| Air Required for Combustion | 200000.00 | lbs/hr |
| | (2.61 | MMSCF/hr) |
| Air Supplied 25% Excess | 250000.00 | lbs/hr |
| | (3.27 | MMSCF/hr) |

COMPRESSOR SUCTION COOLER (5H)

OUTFLOWS

Hydrogen

| | | |
|---|---|---|
| Flowrate | 200000.00 | lbs/hr |
| Temperature | 100.00 | ° F. |
| Required Coolant Supply | 22.42 | MMbtu/hr |

MATERIAL BALANCE

TAR SAND REACTOR (104)

IN FLOWS

Sand

| | | |
|---|---|---|
| Flowrate | 1000.00 | tons/hr |
| Temperature | 50.00 | ° F. |
| Pressure | 14.70 | psia (Force Fed) |

Hydrogen

| | | |
|---|---|---|
| Flowrate | 45.23 | MMSCF/hr |
| Temperature | 1200.00 | ° F. |
| Pressure | 635.00 | psi |

$C_1$–$C_2$'s

| | | |
|---|---|---|
| Flowrate | 0.08 | MMSCF/hr |
| Temperature | 1200.00 | ° F. |
| Pressure | 635.00 | psi |

OUT FLOWS

Sand

| | | |
|---|---|---|
| Flowrate | 850.00 | tons/hr |
| Temperature | 190.00 | ° F. |
| Pressure | 600.00 | psi |

Off Gas

| | | |
|---|---|---|
| Flowrate | 43.92 | MMSCF/hr |
| Temperature | 800.00 | ° F. |
| Pressure | 600.00 | psi |

| Composition | wt % |
|---|---|
| $H_2$ | 81.94 |
| CO | 0.05 |
| $CO_2$ | 0.04 |
| $H_2S$ | 5.60 |
| $NH_3$ | 0.45 |
| $C_3$ | 11.92 |

Product

| | | |
|---|---|---|
| Flowrate (Vapor Phase) | 214937.52 | lbs./hr |
| Temperature | 800.00 | ° F. |
| Pressure | 600.00 | psi |

-continued

SAND COOLER (106, 108)

IN FLOWS

Sand

| | | |
|---|---|---|
| Flowrate | 850.00 | tons/hr |
| Temperature | 791.92 | ° F. |
| Pressure | 600.00 | psi |

Hydrogen

| | | |
|---|---|---|
| Flowrate | 45.23 | MMSCF/hr |
| Temperature | 100.00 | ° F. |
| Pressure | 500.00 | psi |

Air

| | | |
|---|---|---|
| Flowrate | 3.27 | MMSCF/hr |
| Temperature | 50.00 | ° F. |
| Pressure | 30.00 | psi |

OUT FLOWS

Sand

| | | |
|---|---|---|
| Flowrate | 850.00 | tons/hr |
| Temperature | 200.00 | ° F. |
| Pressure | 480.00 | psi |

Hydrogen

| | | |
|---|---|---|
| Flowrate | 45.23 | MMSCF/hr |
| Temperature | 313.94 | ° F. |
| Pressure | 480.00 | psi |

Air

| | | |
|---|---|---|
| Flowrate | 3.27 | MMSCF/hr |
| Temperature | 300.00 | ° F. |
| Pressure | 20.00 | psi |

IN-OUT HEAT EXCHANGER (115)

IN FLOWS

Hydrogen

| | | |
|---|---|---|
| Flowrate | 45.23 | MMSCF/hr |
| Temperature | 147.60 | ° F. |
| Pressure | 670.00 | psi |

Off Gas

| | | |
|---|---|---|
| Flowrate | 43.92 | MMSCF/hr |
| Temperature | 800.00 | ° F. |
| Pressure | 600.00 | psi |

| Composition | wt % |
|---|---|
| $H_2$ | 81.94 |
| CO | 0.05 |
| $CO_2$ | 0.04 |
| $H_2S$ | 5.60 |
| $NH_3$ | 0.45 |
| $C_3$ | 11.92 |

Product

| | | |
|---|---|---|
| Flowrate (Vapor Phase) | 214937.52 | lbs./hr |
| Temperature | 800.00 | ° F. |
| Pressure | 600.00 | psi |

OUT FLOWS

Hydrogen

| | | |
|---|---|---|
| Flowrate | 45.23 | MMSCF/hr |
| Temperature | 750.00 | ° F. |
| Pressure | 650.00 | psi |

Off Gas

| | | |
|---|---|---|
| Flowrate | 43.92 | MMSCF/hr |
| Temperature | 368.63 | ° F. |
| Pressure | 580.00 | psi |

-continued

Off Gas Composition as Above

Product

| | | |
|---|---|---|
| Flowrate (Vapor Phase) | 214937.52 | lbs./hr |
| Temperature | 368.63 | ° F. |
| Pressure | 580.00 | psi |

PRODUCT CONDENSER/COOLER (117)

IN FLOWS

Off Gas

| | | |
|---|---|---|
| Flowrate | 43.92 | MMSCF/hr |
| Temperature | 368.63 | ° F. |
| Pressure | 580.00 | psi |

Off Gas Composition as Above

Product

| | | |
|---|---|---|
| Flowrate (Vapor Phase) | 214937.52 | lbs./hr |
| Temperature | 368.63 | ° F. |
| Pressure | 550.00 | psi |

OUT FLOWS

Off Gas

| | | |
|---|---|---|
| Flowrate | 43.92 | MMSCF/hr |
| Temperature | 100.00 | ° F. |
| Pressure | 540.00 | psi |

Off Gas Composition as Above

Product

| | | |
|---|---|---|
| Flowrate (as condensate) | 214937.52 | lbs./hr |
| Temperature | 100.00 | ° F. |
| Pressure | 540.00 | psi |

AMINE SYSTEM (121, FIG. 5)

IN FLOWS

Hydrogen

| | | |
|---|---|---|
| Flowrate | 45.23 | MMSCF/hr |
| Temperature | 318.00 | ° F. |
| Pressure | 470.00 | psi |

OUT FLOWS

Hydrogen

| | | |
|---|---|---|
| Flowrate | 45.23 | MMSCF/hr |
| Temperature | 100.00 | ° F. |
| Pressure | 450.00 | psi |

While particular embodiments of the present invention have been illustrated and described herein, the present invention is not limited to such illustrations and descriptions. It is apparent that changes and modifications may be incorporated and embodied as part of the present invention within the scope of the following claims.

We claim:

1. A process for producing oil from tar sand comprising the steps of:

a. feeding tar sand in a fluidizable form to a fluidized bed reactor;

b. fluidizing said fluidizable tar sand with substantially only hydrogen in said fluidized bed reactor;

c. continuously reacting said tar sand with said hydrogen in said fluidized bed reactor; and d. continuously discharging a product stream and spent solids from said fluidized bed reactor.

2. The process of claim 1, wherein said tar sand includes bitumen.

3. The process of claim 1, wherein said feeding step (a) includes first treating said tar sand to produce a fluidizable feed.

4. The process of claim 3, wherein said feeding step (a) includes admixing said fluidizable feed with a substantially only hydrogen gas stream to form a dispersible feed, and then injecting said dispersible feed into said reactor.

5. The process of claim 4, wherein said injecting of said dispersible feed includes injecting said dispersible feed at a plurality of locations at an upper end of said reactor.

6. The process of claim 5, wherein said plurality of locations are circumferentially positioned.

7. The process of claim 5, wherein said injecting of said dispersible feed includes fan feeding said dispersible feed.

8. The process of claim 6, wherein said plurality of locations includes at least two locations.

9. The process of claim 6, wherein said plurality of locations includes at least three locations.

10. The process of claim 2, wherein said reaction involves endothermic hydrocracking of said bitumen.

11. The process of claim 10, wherein said reaction also involves exothermic hydrogenation of said bitumen.

12. The process of claim 1, wherein said product stream contains solids and is conveyed to at least one separation zone to produce a cleaned product stream.

13. The process of claim 12, wherein said at least one separation zone includes first and second separation zones, and said first separation zone is located in the upper end of said reactor and produces a first cleaned product stream which is conveyed to a second separation zone to produce a second cleaned product stream.

14. The process of claim 13, wherein said second cleaned product stream at a first temperature is conveyed to a first heat exchanger for cooling said second cleaned product stream to a second, lower temperature.

15. The process of claim 13, wherein said second cleaned product stream at said second temperature is conveyed to condenser to form a gas-liquid product stream.

16. The process of claim 15, wherein said gas-liquid stream is conveyed to a separator wherein product gas is separated and conveyed to an amine scrubber to produce a first recycle gas stream containing hydrogen.

17. The process of claim 4, wherein said hydrogen stream of said feeding and fluidizing steps comprises recycle and fresh-make-up hydrogen.

18. The process of claim 1, further including the step of:

e) supplying a hydrogen stream comprising recycle and fresh make-up hydrogen.

19. The process of claim 18, wherein a first portion of said hydrogen stream is used as the fluidizing medium in step (b).

20. The process of claim 19, wherein a second portion of said hydrogen stream is used in the feeding of step (a).

21. The process of claim 19, wherein said first portion of said hydrogen stream at a first temperature is conveyed through a first heat exchanger, prior to being conveyed to said reactor to raise said first hydrogen stream temperature to a second higher temperature.

22. The process of claim 21, wherein said first portion of said hydrogen stream at said second higher temperature is conveyed to a second heat exchanger to raise said first hydrogen stream portion to a third temperature higher than said second temperature prior to being conveyed to said reactor.

23. A process for treating dry tar sand comprising, a. feeding dry tar sand in admixture with a first portion of a hydrogen stream to a fluidized bed reactor;

b. fluidizing said tar sand of step a) with a second portion of a hydrogen stream whose make-up is substantially only hydrogen in said fluidized bed reactor;

c. reacting bitumen in said tar sand with said hydrogen streams of steps a) and b) to form spent tar sand, synthetic crude oil and an overhead product stream in said fluidized bed reactor; and d. discharging said spent tar sand from a bottom portion of said fluidized bed reactor.

24. The process of claim 23, wherein said first and second portions of said hydrogen stream comprise recycle and make-up hydrogen.

25. The process of claim 24, wherein said first and second portions of said hydrogen stream are at different temperatures.

26. The process of claim 1, wherein said reaction of step c) is conducted at a temperature of about 850° F.

27. The process of claim 23, wherein said reaction of step c) is conducted at a temperature of about 850° F.

28. The process of claim 17, wherein the volume ratio of recycle hydrogen to fresh make-up hydrogen is at least 16:1.

29. The method of claim 1, wherein said hydrogen of step b) is first conveyed to a fired heater that heats the hydrogen stream to a higher temperature than that of reactor which is at 800° F., to provide all of the additional heat required to offset the cold tar sand or shale produced in the reactor and bring the feed of step a) up to the reaction temperature.

30. The process of claim 29, wherein air for the fired heater is pre-heated by indirect heat exchange with spent sand or shale.

31. The process of claim 29, wherein said heater provides all of the superheated steam to fire the hydrogen and $C_1$ and $C_2$ gas compression.

32. The process of claim 30, wherein the sand or shale heat exchangers, hydrogen and air recover the majority of heat needed to offset the cold tar sand or shale being fed to the reactor.

33. The process of claim 30, wherein said cooled spent sand or shale is used as land fill.

34. The process of claim 1, wherein said process is carried out in the presence of a catalyst.

35. The process of claim 34, wherein said catalyst is a heavy metal.

36. The process of claim 34, wherein said catalyst promotes hydrocracking.

37. The process of claim 34, wherein said catalyst promotes hydrogenation.

38. The process of claim 1, wherein a catalyst is admixed with said tar sand.

39. The process of claim 23, wherein said tar sand further comprises a catalyst.

40. The process of claim 23, wherein a catalyst is admixed with said tar sand.

41. The process of claim 39, wherein the catalyst is a heavy metal.

* * * * *